US010289045B2

(12) United States Patent
Mukoyama et al.

(10) Patent No.: US 10,289,045 B2
(45) Date of Patent: May 14, 2019

(54) FIXING BELT AND FIXING DEVICE AND IMAGE FORMING APPARATUS USING THE SAME

(71) Applicant: Konica Minolta, Inc., Tokyo (JP)

(72) Inventors: Izumi Mukoyama, Hachioji (JP); Hirofumi Koga, Hino (JP); Naoko Uemura, Hachioji (JP); Asao Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 1 day.

(21) Appl. No.: 15/455,806

(22) Filed: Mar. 10, 2017

(65) Prior Publication Data

US 2017/0277090 A1 Sep. 28, 2017

(30) Foreign Application Priority Data

Mar. 22, 2016 (JP) ..... 2016-057462

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS 6,219,522 B1 * 4/2001 Ishizuka ..... G03G 15/2053 399/333
2004/0184851 A1 * 9/2004 Otsuka ..... G03G 15/2053 399/329
2005/0047839 A1 * 3/2005 Shimizu ..... G03G 15/162 399/333
2007/0122216 A1 * 5/2007 Omata ..... G03G 15/2064 399/329
2010/0272458 A1 * 10/2010 Yoshikawa ..... G03G 15/6573 399/68

FOREIGN PATENT DOCUMENTS

JP 2005300591 A 10/2005

* cited by examiner

*Primary Examiner* — Benjamin R Schmitt
*Assistant Examiner* — Milton Gonzalez
(74) *Attorney, Agent, or Firm* — Lucas & Mercanti, LLP

(57) ABSTRACT

A fixing belt contains a base layer made of a heat-resistant resin, an elastic layer made of an elastic material, and a release layer, laminated in this order. The elastic layer has a linear thermal expansion coefficient of $-4.0\times10^{-4}$ (1/K) or more and $1.0\times10^{-4}$ (1/K) or less.

8 Claims, 3 Drawing Sheets

FIXING BELT AND FIXING DEVICE AND IMAGE FORMING APPARATUS USING THE SAME

The entire disclosure of Japanese Patent Application No. 2016-057462 filed on Mar. 22, 2016 including description, claims, drawings, and abstract are incorporated herein by reference in its entirety.

BACKGROUND OF THE INVENTION

Field of the Invention

The present invention relates to a fixing belt and a fixing device and an image forming apparatus using the same.

Description of the Related Art

In a fixing device adopted in an image forming apparatus such as a copying machine or a laser beam printer, a heated fixing belt is usually brought into contact with a recording medium carrying an unfixed toner image to fix the toner image onto the recording medium. Next, the recording medium onto which the toner image is fixed is separated from the fixing belt. The fixing belt is, for example, an endless belt in which abase layer, an elastic layer, and a release layer are laminated in this order.

In the elastic layer used in such a fixing belt, compatibility between high thermal conductivity and low hardness has been demanded in order to satisfactorily melt-fix the toner image onto the recording medium. As a technique that meets such a demand, for example, JP 2005-300591 A discloses a technique capable of controlling rubber elasticity while having high thermal conductivity by using a specific elastic layer including a thermally conductive filler (filler) and an additional reaction type silicone rubber cured product. More specifically, particle diameters having two peaks in the curves of the area ratio of the thermally conductive filler in the cross-section of the elastic layer in the thickness direction and the volume-based frequency distribution of the particle diameter of the thermally conductive filler and tan 5 in a dynamic viscoelasticity measurement at 180° C. are set within a predetermined range.

However, in the fixing belt using the conventional elastic layer, particularly, the elastic layer containing the filler as in JP 2005-300591 A, since the releasability between the fixing belt and the recording medium (for example, a sheet or the like) having the toner image melt-fixed thereon is not sufficient, there still remains a problem that defects caused by peeling occur in the obtained toner image.

SUMMARY OF THE INVENTION

Here, the present invention has been made in view of the above-described problems, and an object of the present invention is to provide a fixing belt and a fixing device and an image forming apparatus using the same, the fixing belt realizing excellent releasability between the fixing belt and a recording medium having a toner image melt-fixed thereon.

Here, the present inventors examined a fixing belt having a configuration in which a base layer, an elastic layer, and a release layer are laminated in this order. Then, the present inventors surprisingly found that the above-described problems can be solved by forming the fixing belt to have a predetermined laminated structure and controlling the linear thermal expansion coefficient of the elastic layer to a value within a predetermined range and completed the present invention.

That is, the above-described problems of the present invention are solved by the following means.

To achieve the abovementioned object, according to one aspect of the present invention, the fixing belt is provided wherein a base layer made of heat-resistant resin, an elastic layer made of an elastic material, and a release layer are laminated in this order, and the elastic layer has a linear thermal expansion coefficient of $-4.0\times10^{-4}$ (1/K) or more and $1.0\times10^{-4}$ (1/K) or less.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
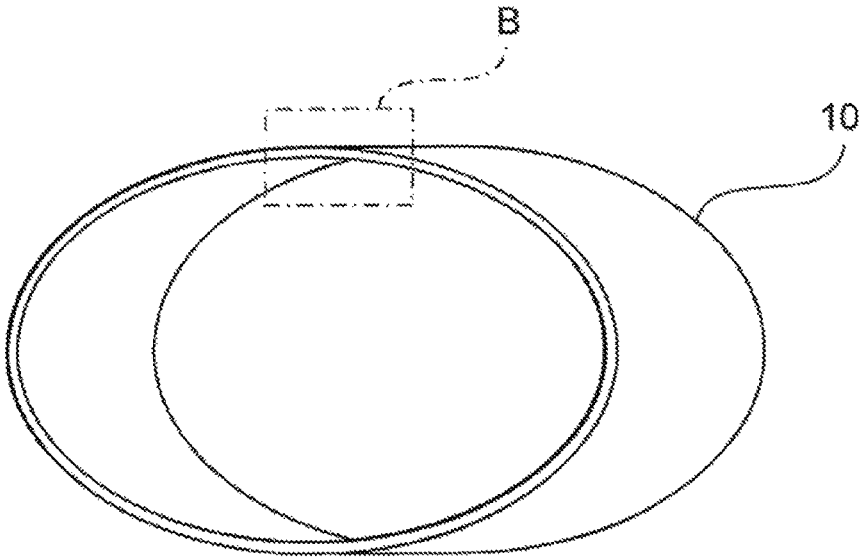
FIG. 1A is a schematic diagram illustrating an example of a fixing belt according to an embodiment of the present invention.

Hereinafter, an embodiment of the present invention will be described with reference to the drawings. However, the scope of the invention is not limited to the illustrated examples.

An embodiment of the present invention is a fixing belt in which a base layer made of heat-resistant resin, an elastic layer made of an elastic material, and a release layer are laminated in this order and the elastic layer has a linear thermal expansion coefficient of $-4.0\times10^{-4}$ (1/K) or more and $1.0\times10^{-4}$ (1/K) or less.

The present inventors presume a mechanism solving the above-described problems by such a configuration as follows.

In the fixing device, the peeling between the fixing belt having passed through a fixing part and a recording medium having a toner image melt-fixed thereon is achieved in such a manner that a wax component contained in toner leaks and enters a space existing between the fixing belt and toner particles. However, when an elastic layer has a predetermined linear thermal expansion coefficient of $-4.0\times10^{-4}$ (1/K) or more, the space between the fixing belt and the toner particles decreases during a fixing operation because the heated elastic layer expands in the thickness direction. As a result, since the amount of the wax component entering the space between the fixing belt and the toner particles during the fixing operation decreases, the releasability deteriorates. Meanwhile, when the elastic layer has a predetermined linear thermal expansion coefficient $1.0\times10^{-4}$ (1/K) or less, a shrinkage amount of the elastic layer increases. As a result, since the elastic layer is deteriorated at the time of such shrinkage, the releasability deteriorates.

Here, in the present invention, since the linear thermal expansion coefficient of the elastic layer is controlled to a value within a predetermined range, the space between the fixing belt and the toner particles is ensured and thus a sufficient amount of the wax component can enter such a space. Further, in the present invention, since the excessive shrinkage of the elastic layer is prevented, deterioration of the elastic layer due to the shrinkage is prevented. Accordingly, the fixing belt according to the present invention has excellent releasability between the fixing belt and the recording medium having the toner image melt-fixed thereon.

Further, in the present invention, a particularly remarkable effect is exhibited in the fixing belt using the elastic layer containing a filler. A filler such as a thermally conductive filler has an effect of giving high thermal conductivity to the elastic layer. However, there is a tendency that the function as the elastic layer tends to be deteriorated by the addition of the filler. For this reason, when designing the elastic layer containing the filler, it is necessary to design the elastic layer to enhance the mobility of molecules in the elastic layer so that the function as the elastic layer can be sufficiently exhibited even when the filler is added. Here, as a method for increasing the mobility of molecules in the layer, there is a method of decreasing the number of nodes between polymers forming the elastic layer. The number of nodes between polymers is related to the linear thermal expansion coefficient which is one type of thermophysical properties, and as the number of nodes between polymers decreases, the linear thermal expansion coefficient which is a response to heat also increases. Accordingly, as a result of designing the elastic layer containing the filler so as to sufficiently exhibit the function as the elastic layer, the linear thermal expansion coefficient becomes large. Meanwhile, in order to improve the releasability, it is necessary to ensure a space between the fixing belt and the toner particles by controlling the linear thermal expansion coefficient to a certain value $1.0\times10^{-4}$ (1/K) or less as described above. Thus, in the elastic layer containing the filler, it is desirable that the linear thermal expansion coefficient has a value enough to exhibit sufficient releasability while having a sufficient function as an elastic layer. Then, in the present invention, since the linear thermal expansion coefficient of the elastic layer containing the filler is controlled to a value within the range defined by the present invention, it is possible to manufacture the elastic layer which has high thermal conductivity, a satisfactory function as the elastic layer, and improved releasability.

The above-described mechanism is based on a presumption and its correctness does not affect the technical scope of the present invention.

Hereinafter, preferred embodiments of the present invention will be described. It is noted that the present invention is not limited to the following embodiments. Further, in the specification, "X to Y" indicating a range means "X or more and Y or less". Unless otherwise specified, operation and physical properties are measured under the conditions of room temperature (20 to 25° C.)/relative humidity of 40 to 50% RH.

[Fixing Belt]

<Configuration of Fixing Belt>

A fixing belt according to an embodiment of the present invention has a configuration in which a base layer made of heat-resistant resin, an elastic layer made of an elastic material, and a release layer are laminated in this order. The fixing belt has an endless shape.

It is noted that the physical properties such as the hardness (belt hardness) of the fixing belt are not particularly limited as long as the value of the linear thermal expansion coefficient of the elastic layer is within the range of the present invention and can be set to appropriate optimal values according to specifications of the fixing device or the image display device using the fixing belt.

(Base Layer)

It is essential that the base layer is made of heat-resistant resin. In the specification, the heat-resistant resin indicates resin which does not undergo denaturation and deformation at the use temperature of the fixing belt.

Here, as the heat-resistant resin, a value of a glass transition point is desirably 150° C. or higher, more desirably 200° C. or higher, and still more desirably 250° C. or higher. An upper limit is not particularly limited, but 350° C. or lower is desirable. The glass transition point can be measured from a film-shaped sample using a solid dynamic viscoelasticity measuring device (a tensile mode).

The heat-resistant resin is not particularly limited, but examples thereof include polyphenylene sulfide, polyarylate, polysulfone, polyether sulfone, polyether imide, polyimide, polyamide imide, and polyether ether ketone. Among them, polyimide is preferable from the viewpoint of heat-resistance. Incidentally, the heat-resistant resin may be used alone or in combination of two or more.

Polyimide can be obtained by the dehydration/cyclization (imidization) reaction of polyamic acid, which is a precursor thereof, by heating at 200° C. or higher or using a catalyst. The polyamic acid may be produced by the polycondensation reaction in which the tetracarboxylic acid dianhydride and the diamine compound are dissolved in a solvent and are mixed and heated or a commercially available product may be used. Examples of the diamine compound and the tetracarboxylic acid dianhydride include the compounds described in paragraphs 0123 to 0130 of JP 2013-25120 A.

The base layer may further contain components other than the heat-resistant resin within the range where the effect of the present invention can be obtained. For example, the base layer material may further contain another resin component. From the viewpoint of moldability and the like, the content of the heat-resistant resin in the material of the base layer is desirably 40 to 100 vol % with respect to the volume of the resin layer.

The thickness of the base layer is not particularly limited, but is desirably 50 μm or more and 150 μm or less, more desirably 60 μm or more and 120 μm or less, and still more desirably 70 μm or more and 100 μm or less from the viewpoint of durability.

(Elastic Layer)

It is essential that the elastic layer is made of an elastic material and has a linear thermal expansion coefficient of $-4.0\times10^{-4}$ (1/K) or more and $1.0\times10^{-4}$ (1/K) or less.

As the elastic material, a heat-resistant elastic material is desirable from the viewpoint of heat-resistance. In the specification, the heat-resistant elastic material indicates an elastic material that does not decompose at the fixing temperature. For example, the heat-resistant elastic material is not decomposed desirably at 180° C., more desirably at 190° C., and still more desirably at 250° C. or higher.

As the heat-resistant elastic material, the value of the compression set is desirably 50% or less, more desirably 30% or less, and still more desirably 20% or less. The compression set can be measured according to JIS K 6262: 2013.

As the elastic material, for example, elastic resin materials such as silicone rubber, fluorine rubber, thermoplastic elastomer, and a rubber material are exemplified. The type of the elastic resin material is not particularly limited, but examples thereof include thermoplastic resin, thermosetting resin, photocurable resin, and the like. Among them, it is desirable that the elastic material be silicone rubber from the viewpoint of heat-resistance and elasticity. The silicone rubber is not particularly limited, but for example, a heat-cured product of a silicone rubber synthesis composition including an appropriate combination of polyorganosiloxane and organohydrogenpolysiloxane described in JP 2006-336668 A, JP 2008-255283 A, and JP 2009-122317 A can be exemplified. In the specification, the silicone rubber synthesis composition means a composition including a silicone which forms silicone rubber by curing and, if necessary, any other components described below. Further, the elastic resin materials can be used along or in combination of two or more.

The elastic material according to an embodiment of the present invention may further include a component other than the elastic resin material. The component other than the elastic resin material is not particularly limited, but for example, a thermally conductive filler which is one type of the filler is desirable from the viewpoint of remarkably exhibiting the effect of the present invention by improving the thermal conductivity of the elastic layer. The reason is presumed as below. When the linear thermal expansion coefficient of the elastic layer is controlled to a value within the range defined by the present invention, excessive shrinkage of the elastic layer can be prevented while a space between the fixing belt and the toner particles is ensured even in a system including the filler.

The thermally conductive filler is not particularly limited and examples thereof include silica, metallic silica, alumina, zinc oxide, aluminum nitride, boron nitride, silicon nitride, silicon carbide, carbon, graphite, and the like. The form of the thermally conductive filler is not particularly limited and examples thereof include a spherical powder, an amorphous powder, a flat powder, a fibrous powder, and the like. Thermally conductive fillers can be used alone or in combination of two or more.

The content of the elastic resin material in the elastic material is desirably 60 vol % or more, more desirably 75 vol % or more, and still more desirably 80 vol % or more with respect to the volume of the elastic layer from the viewpoint of further improving the function of the elastic layer and further improving the releasability. Further, the content of the elastic resin material in the elastic material is desirably 100 vol % or less, more desirably 80 vol % or less, and still more desirably 60 vol % or less with respect to the volume of the elastic layer from the viewpoint of realizing the higher thermal conductivity and further reducing the shrinkage deterioration of the elastic layer.

It is essential that the elastic layer has a linear thermal expansion coefficient of $-4.0\times10^{-4}$ (1/K) or more and $1.0\times10^{-4}$ (1/K) or less. Here, when the linear thermal expansion coefficient is larger than $1.0\times10^{-4}$ (1/K), the releasability deteriorates. As described above, the reason is presumed as below. When the heated fixing belt is expanded in the thickness direction, the space between the fixing belt and the toner particles decreases during the fixing operation and the amount of the wax component entering the space between the fixing belt and the toner particles during the fixing operation decreases, so that the releasability deteriorates. Further, when the linear thermal expansion coefficient is smaller than $-4.0\times10^{-4}$ (1/K), the releasability deteriorates. As described above, the reason is presumed as below. When the shrinkage amount of the elastic layer increases, the elastic layer deteriorates during the shrinkage, so that the releasability deteriorates. Accordingly, it is essential that the linear thermal expansion coefficient of the elastic layer is within the above-described range. From the same viewpoint, it is desirable that the linear thermal expansion coefficient be $-1.5\times10^{-4}$ (1/K) or more and $1.0\times10^{-5}$ (1/K) or less. Further, in the specification, a value which is obtained from a measurement result of an expansion rate when a temperature rises from 20° C. to 250° C. at 5° C./min is used as the linear thermal expansion coefficient. A detailed method of measuring the linear thermal expansion coefficient is described in Examples.

Here, the linear thermal expansion coefficient of the elastic layer can be controlled by the type or content of the elastic resin material (that is, for example, the type of polyorganosiloxane or organohydrogenpolysiloxane which is a raw material compound of silicone rubber, the content of reactive sites such as a vinyl group or Si—H group present in these molecules, etc.), the type or content of the thermally conductive filler, the forming conditions of the elastic layer (for example, curing conditions, etc.), and the like.

The physical properties such as hardness (rubber hardness), strength, and elongation of the elastic layer are not particularly limited as long as the value of the linear thermal expansion coefficient of the elastic layer is within the range of the present invention and can be set to an appropriate optimal value according to the specification of the fixing belt or the fixing device or the image display device using the fixing belt.

The thickness of the elastic layer is desirably 50 μm or more and 400 μm or less, more desirably 70 μm or more and 350 μm or less, and still more desirably 90 μm or more and 300 μm or less from the viewpoint of satisfactorily exhibiting the thermal conductivity and the elasticity.

(Release Layer)

The release layer is a layer having appropriate releasability to the toner component. The release layer constitutes the outer surface of the fixing belt which abuts on the recording medium during the fixing operation.

The release layer forming material is not particularly limited as long as the releasability can be applied to the toner component and, for example, polyethylene, polypropylene, polystyrene, polyisobutylene, polyester, polyurethane, polyamide, polyimide, polyamideimide, alcohol soluble nylon, polycarbonate, polyarylate, phenol, polyoxymethylene, polyetheretherketone, polyphosphazene, polysulfone, polyethersulfide, polyphenylene Oxides, polyphenylene ether, polyparabanic acid, polyallylphenol, fluororesin, polyurea, ionomer, silicone, and mixtures or copolymers thereof can be exemplified. Among them, it is desirable that the material of the release layer be fluororesin from the viewpoints of releasability and heat-resistance. The fluororesin is not particularly limited and, for example, tetrafluoroethylene-perfluoroalkyl vinyl ether copolymer (hereinafter, also referred to as perfluoroalkoxy fluorine resin) (PFA) polytetrafluoroethylene (PTFE), ethylene/tetrafluoroethylene copolymer (ETFE), tetrafluoroethylene/hexafluoropropylene copolymer (FEP), polychlorotrifluoroethylene (PCTFE), ethylene/chlorotrifluoroethylene polymers (ECTFE), and the like can be exemplified. Among them, perfluoroalkoxy fluorine resin (PFA) is more desirable. These materials may be used alone or in combination of two or more.

The release layer according to an embodiment of the present invention may further include a component other than the above-described material (matrix material). The other component is not particularly limited and, for example, lubricant particles can be exemplified. The lubricant particles are not particularly limited and, for example, fluororesin particles, silicone resin particles, silica particles, and the like can be exemplified.

The content of the matrix material in the release layer forming material is desirably 70 vol % or more and 100 vol % or less with respect to the volume of the release layer from the viewpoint of improving the thermal conductivity of the release layer and further improving the flexibility of the release layer so as to improve the followability of the release layer with respect to the deformation of the elastic layer.

From the viewpoint of more satisfactorily exhibiting the thermal conductivity, the followability with respect to the deformation of the elastic layer, and the releasability, the thickness of the release layer is desirably 5 μm or more and 40 μm or less, more desirably 5 μm or more and 35 μm or less, and still more desirably 5 μm or more and 30 μm or less.

(Other Layers)

The fixing belt according to an embodiment of the present invention may further include layers other than the base layer, the elastic layer, and the release layer within the range in which the effect of the present invention can be obtained. The other layers are not particularly limited and include, for example, a reinforcement layer and the like.

The reinforcement layer is a layer which improves the mechanical strength of the fixing belt. For example, the reinforcement layer may be disposed on a surface (an inner peripheral surface of the base layer) opposite to the elastic layer and the release layer in the fixing belt. The reinforcement layer can be made of the heat-resistant resin described in the base layer and the thickness thereof can be appropriately set.

(Fixing Belt Manufacturing Method)

The fixing belt according to an embodiment of the present invention can be manufactured by using a known method for manufacturing a lamination type fixing belt. Here, the method is not particularly limited, but for example, a method described in JP 2006-58809 A can be used.

As a method of manufacturing the fixing belt, it is desirable to use a method including a step of covering an outer surface of an endless molded body made of heat-resistant resin and serving as abase layer with a tube serving as a release layer, a step of injecting an elastic material or a precursor thereof between the molded body and the tube, and a step of heating and curing the elastic material or the precursor thereof if necessary.

Hereinafter, an embodiment of the present invention will be described with reference to the accompanying drawings. It should be noted that the same reference numerals will be given to the same components in the description of the drawings and a repetitive description thereof will be omitted. Further, the dimensional ratios of the drawings are exaggerated for convenience of description and may be different from the actual ratio.

Figure 1B:
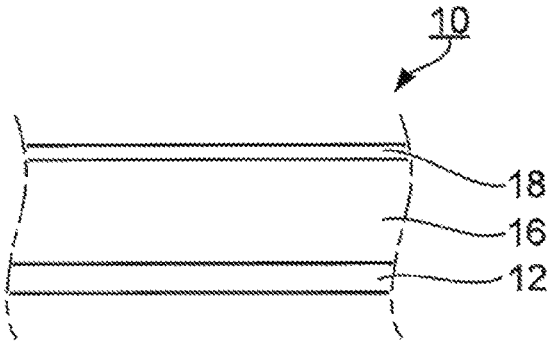
FIG. 1B is an enlarged view of a part B of FIG. 1A.

An example of the fixing belt according to an embodiment of the present invention is illustrated in FIGS. 1A and 1B. FIG. 1A is a schematic diagram illustrating an example of the fixing belt according to an embodiment of the present invention and FIG. 1B is an enlarged view of a part B in FIG. 1A.

The fixing belt 10 has an endless shape as illustrated in FIG. 1A and includes a base layer 12, an elastic layer 16 which is disposed on the outer peripheral surface of the base layer 12, and a release layer 18 which is disposed on the outer peripheral surface of the elastic layer 16 as illustrated in FIG. 1B. Here, as for the fixing belt 10, the base layer 12 is made of polyimide, the elastic layer 16 is made of silicone rubber, and the release layer 18 is desirably made of fluororesin. It is more desirable that the fluororesin is perfluoroalkoxy fluorine resin.

For example, the elastic layer 16 can be made of silicone rubber obtained by mixing two or more types of dimethylpolysiloxanes having a trimethylsiloxane group at both ends and having a vinyl group at a side chain and by crosslinking (curing) the vinyl group through heating.

The fixing belt 10 described above is suitably adopted as a fixing belt in the following two-axis belt type fixing device and is particularly remarkable in an image forming apparatus at a high speed (for example, 60 sheets/min or more as a fixing speed described later).

[Fixing Device]

Another embodiment of the present invention is a fixing device using the fixing belt according to the embodiment of the present invention.

The fixing device according to another embodiment of the present invention is a fixing device using the fixing belt according to the embodiment of the present invention, the fixing device including an endless fixing belt, two or more rollers which axially support the fixing belt, a fixing member that includes a heating device for heating the fixing belt, and a pressing roller which is disposed while being relatively urged toward one of the rollers with the fixing belt interposed therebetween. Here, it is desirable that the roller urged by the pressing roller among the rollers have a roller diameter of 50 mm or more. Further, the fixing device can have the same configuration as that of the known two-axis belt type fixing device except for the fixing belt according to the embodiment of the present invention is provided.

Two or more rollers are provided to axially support the fixing belt and include a heating device for heating the fixing belt. For example, the heating device may be a heating roller which includes a heat transfer sleeve made of aluminum and a heating source such as a halogen heater disposed inside the sleeve and the heating source may be a halogen heater disposed to face the fixing belt. Further, the outer peripheral surface of the sleeve may be coated by a layer made of fluororesin such as polytetrafluoroethylene (PTFE).

The number of the rollers other than the roller axially supporting the fixing belt may be one or more and can be appropriately set according to desired other functions.

From the viewpoint of applying the fixing belt to a higher-speed image formation, it is desirable to axially support the fixing belt by two or more rollers so that the tension becomes 45 N or less. Furthermore, it is more desirable to axially support the fixing belt by two or more rollers so that the tension becomes 43 N or less. As the tension of the fixing belt, the tension between the rollers can be measured by a spring. The tension of the fixing belt can be adjusted by, for example, an elastic force (urging force) of an elastic member such as a spring that urges the roller in a direction to enlarge the distance between the axes of the rollers, the interracial distance of the rollers that axially support the fixing belt, and the like.

The pressing roller constitutes a contact portion (a fixing nip portion) with respect to the fixing belt during the fixing operation. Examples of the pressing roller include a roller which has elasticity on its outer peripheral surface and a roller of which a rotational axis is movable toward and away from the fixing belt.

From the viewpoint of applying the fixing belt to a higher-speed image formation, it is desirable that the roller diameter of the roller urged by the pressing roller among two or more rollers axially supporting the fixing belt be desirably 50 mm or more and more desirably 60 mm or more. The upper limit of the roller diameter of the roller urged by the pressing roller can be appropriately determined by, for example, an allowable size in the fixing device.

Further, it is desirable that a separation angle of a recording medium having been subjected to the fixing operation in the fixing device be 67 to 85° from the viewpoint of applying the fixing device to a higher-speed image formation. The separation angle indicates an angle (θ in FIG. 2) formed by a tangential line (L2 in FIG. 2) of the fixing belt at the downstream end of the recording medium in the conveying direction at the fixing nip portion with respect to the line (L1 in FIG. 2) which is parallel to the line connecting the shafts of two rollers forming the fixing nip portion.

When the roller diameter of the roller urged by the pressing roller increases, the separation angle increases. In general, when the roller diameter of the roller urged by the pressing roller is large and the separation angle is large, it is advantageous for high-speed image formation in which a large amount of heat can be supplied. However, since an angle formed between the fixing belt and the recording medium having the toner image melt-fixed thereon decreases in accordance with an increase in separation angle, an increase in the roller diameter of the roller urged by the pressing roller tends to be disadvantageous from the viewpoint of the releasability of the recording medium with respect to the fixing belt. However, the fixing belt according to the embodiment of the present invention satisfies the above-described condition of the linear thermal expansion coefficient. Even at a comparatively large separation angle which has been considered to be disadvantageous for speeding up image formation, sufficient releasability is exhibited. From the viewpoint of achieving both high-speed image formation and releasability, the separation angle is more desirably from 70 to 81° and still more desirably from 73 to 77°.

The separation angle can be adjusted by, for example, the roller diameter of the roller constituting the fixing nip portion, the image forming speed, the urging force (nip pressure) of the pressure roller, and the like.

The fixing device may further have a configuration other than the above-described configuration as long as the effect of the present invention can be obtained. The other configuration is not particularly limited. For example, a first temperature sensor detecting a temperature of the fixing belt heated by the heating device, a shaft moving mechanism of the pressing roller, a second heater disposed inside the pressing roller, a second temperature sensor detecting a temperature of the pressing roller, a guide member guiding the recording medium toward the fixing nip portion and from the fixing nip portion, and the like can be exemplified. For these other configurations, known members and the like adopted in the known fixing apparatus can be adopted.

Since the fixing device includes the fixing belt according to the embodiment of the present invention, the recording medium can be peeled with high releasability. For this reason, the fixing device according to the embodiment of the present invention may not separately include a separating device (for example, an airflow separating device for generating an airflow for peeling off the recording medium, etc.).

Hereinafter, an example of a fixing device according to an embodiment of the present invention will be described in more detail with reference to the accompanying drawings. It should be noted that the same reference numerals will be given to the same components in the description of the drawings and a repetitive description thereof will be omitted. Further, the dimensional ratios of the drawings are exaggerated for convenience of description and may be different from the actual ratio.

Figure 2:
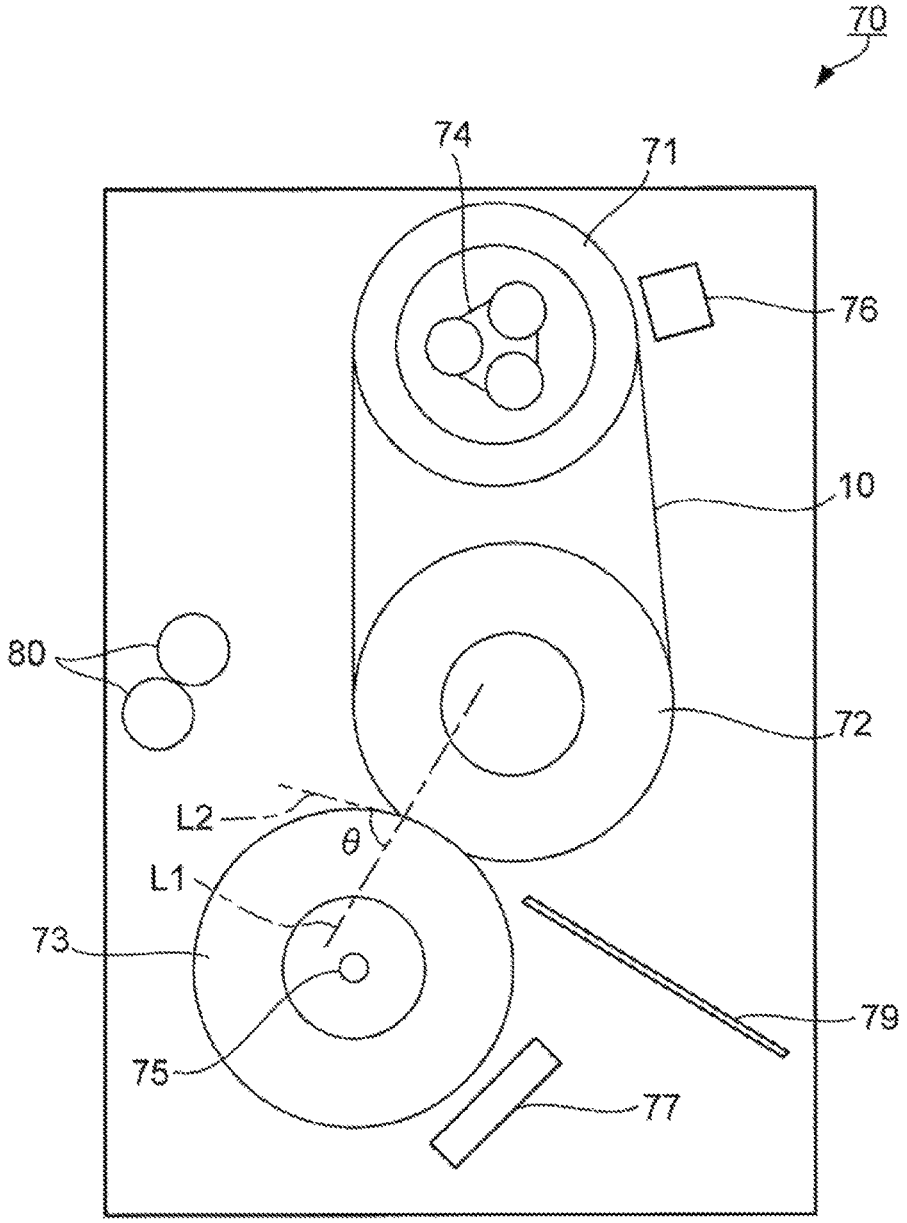
FIG. 2 is a schematic diagram illustrating an example of a fixing device according to another embodiment of the present invention.

FIG. 2 is a schematic diagram illustrating an example of a fixing device according to an embodiment of the present invention.

For example, as illustrated in FIG. 2, a fixing device 70 includes a fixing belt 10, a heating roller 71, a first pressing roller 72 (corresponding to the roller urged by the pressing roller among two or more rollers axially supporting the fixing belt), a second pressing roller 73 (corresponding to the pressing roller disposed while being relatively urged toward one of two or more rollers with the fixing belt interposed therebetween), heaters 74 and 75, a first temperature sensor 76, a second temperature sensor 77, a guide plate 79, and guide rollers 80.

The fixing belt 10 is a fixing belt according to the embodiment of the present invention. The fixing belt 10 is stretched between the heating roller 71 and the first pressing roller 72 while being axially supported thereto. The tension of the fixing belt 10 is, for example, 43 N.

The heating roller 71 includes a rotatable aluminum sleeve and the heater 74 disposed therein. The first pressing roller 72 includes, for example, a rotatable core and an elastic layer disposed on the peripheral surface thereof.

The second pressing roller 73 is disposed to face the first pressing roller 72 with the fixing belt 10 interposed therebetween. The second pressing roller 73 includes, for example, a rotatable aluminum sleeve and the heater 75 disposed inside the sleeve. The second pressing roller 73 is disposed to be movable toward and away from the first pressing roller 72. When the second pressing roller 73 approaches the first pressing roller 72, the elastic layer of the first pressing roller 72 is pressed with the fixing belt 10 interposed therebetween and thus a fixing nip portion which is a contact portion with respect to the fixing belt 10 is formed.

The first temperature sensor 76 is a device which detects a temperature of the fixing belt 10 heated by the heating roller 71 and the second temperature sensor 77 is a device which detects a temperature of the outer peripheral surface of the second pressing roller 73.

The guide plate 79 is a member that guides a recording medium carrying an unfixed toner image to the fixing nip portion and the guide rollers 80 are members that guide a recording medium having a toner image fixed thereto from the fixing nip portion toward the outside of the image forming apparatus.

In the fixing device 70, the roller diameter of the first pressing roller 72 is, for example, 60 mm, the rotational moving speed of the fixing belt 10 is 315 m/sec, and the separation angle θ is 73°. The rotational moving speed of the fixing belt 10 is 60 sheets/min at the image forming speed (the "fixing speed" or the "printing speed") of the recording medium of A4 size.

The separation angle θ indicates an angle on the side of the second pressing roller 73 among the angle formed by the tangential line of the fixing belt 10 at the downstream end of the recording medium in the conveying direction at the fixing nip portion with respect to the line L1 which is parallel to the line connecting the rotation shaft of the first pressing roller 72 and the rotation shaft of the second pressing roller 73 in FIG. 2. The separation angle θ can be adjusted by the roller diameter and the like of the second pressing roller 73.

For example, when the separation angle at which the roller diameter of the second pressing roller 73 is 50 mm is denoted by $\theta_{50}$ (for example, 79°), the separation angle $\theta_{60}$ becomes $(\theta_{50}+4)$ ° when the roller diameter of the second pressing roller 73 is 60 mm.

The fixing belt 10 is rotated at the above-described speed and is heated to a desired temperature (for example, 190° C.) by the heater 74 in accordance with, for example, the feedback control of the first temperature sensor 76. The second pressing roller 73 is heated to a desired temperature (for example, 180° C.) by the heater 75 in accordance with, for example, the feedback control of the second temperature sensor 77. Then, the second pressing roller 73 urges the outer peripheral surface of the first pressing roller 72 with the fixing belt 10 interposed therebtween in accordance with the arrival of the recording medium to form the fixing nip portion.

The recording medium carrying the unfixed toner image is guided by the guide plate 79 to the nip portion. The sufficiently heated fixing belt 10 sufficiently adheres to the recording medium so that the unfixed toner image is quickly fixed onto the recording medium.

The recording medium having the toner image fixed thereon at the downstream end of the fixing nip portion receives a force adhering to the fixing belt 10 and a force moving in the tangential direction of the fixing belt 10. The fixing belt 10 which satisfies the above-described condition of the linear thermal expansion coefficient exhibits appropriate releasability with respect to the recording medium at the downstream end of the fixing nip portion. As a result, the recording medium moves away from the fixing belt 10 and moves in the tangential direction of the fixing belt 10.

The recording medium which is peeled off from the fixing belt 10 is guided by the guide rollers 80 toward the outside of the image forming apparatus.

It is noted that the fixing nip portion may be formed by recessing the peripheral surface of the first pressing roller 72 and the fixing belt 10 or the peripheral surface of the second pressing roller 73 as described above.

In this way, since the fixing device is appropriately adopted in the fixing device of the electrophotographic image forming apparatus and is particularly adopted in the high-speed image forming apparatus, a remarkable effect is exhibited.

[Image Forming Apparatus]

Still another embodiment of the present invention is an image forming apparatus using the fixing device according to the embodiment of the present invention.

The image display device according to still another embodiment of the present invention is desirably an image forming apparatus which includes a fixing device fixing an unfixed toner image formed on a recording medium according to an electrophotographic method into the recording medium by heating and pressing and the fixing device is a fixing device according to the embodiment of the present invention. The image forming apparatus can be configured similarly to the known image forming apparatus except that the fixing device is adopted as a fixing device. The image forming apparatus can be configured similarly to, for example, a full-color copying machine (bizhub (registered trademark) press C1070, manufactured by KONICA MINOLTA, INC.) etc. except that the fixing device is adopted as a fixing device.

Hereinafter, an example of the image forming apparatus according to the embodiment of the present invention will be described with reference to the accompanying drawings. It should be noted that the same reference numerals will be given to the same components in the description of the drawings and a repetitive description thereof will be omitted. Further, the dimensional ratios of the drawings are exaggerated for convenience of description and may be different from the actual ratio.

Figure 3:
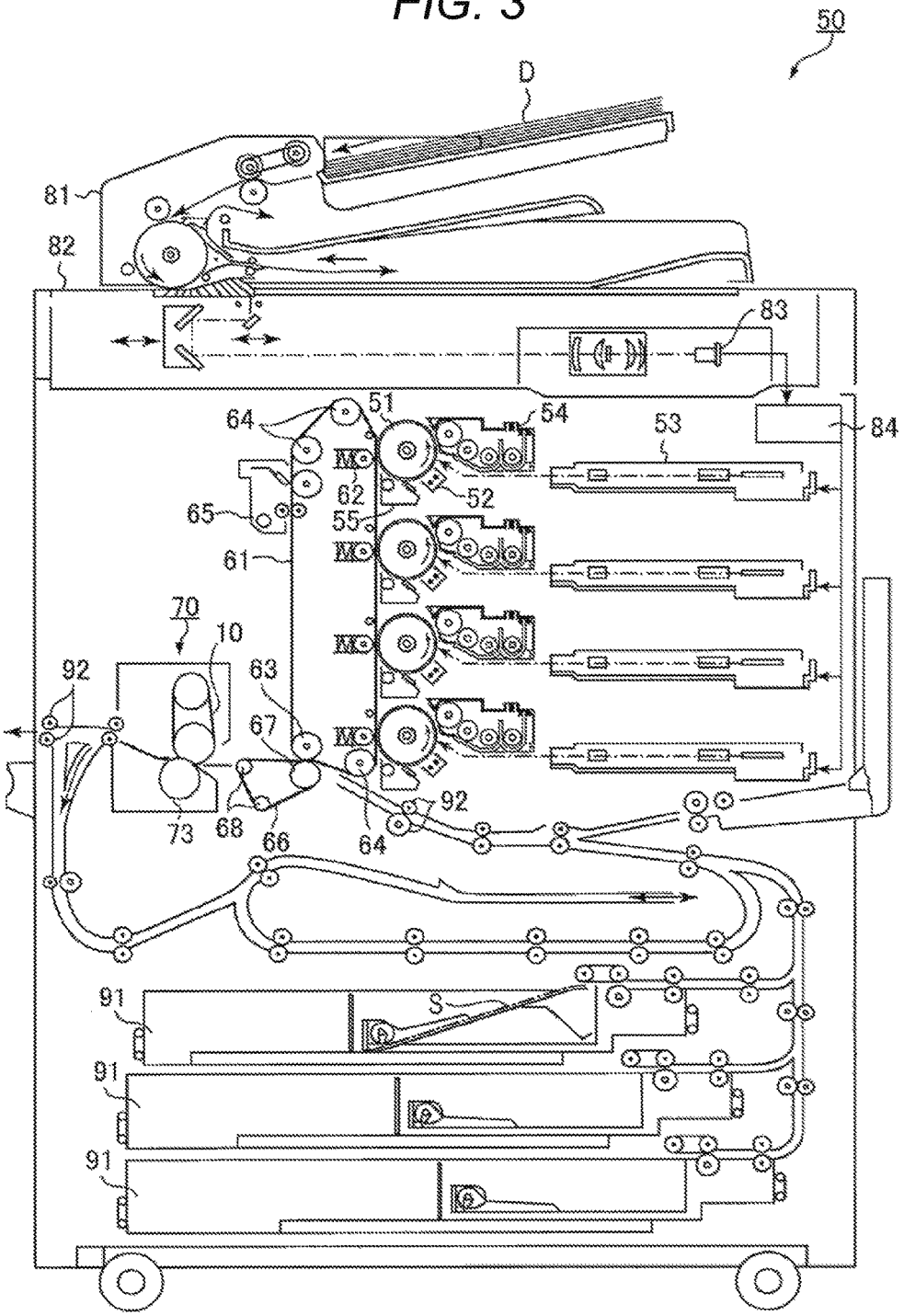
FIG. 3 is a schematic diagram illustrating an example of an image forming apparatus according to still another embodiment of the present invention.

FIG. 3 is a schematic diagram illustrating an example of an image forming apparatus according to an embodiment of the present invention.

As illustrated in FIG. 3, an image forming apparatus 50 includes an image forming part, an intermediate transfer part, a fixing device 70, an image reading part, and a recording medium conveying part.

The image forming part includes, for example, four image forming units respectively corresponding to yellow, magenta, cyan, and black. The image forming unit includes, as illustrated in FIG. 3, a photosensitive drum 51, a charging device 52 which charges the photosensitive drum 51, an exposure device 53 which irradiates light to the charged photosensitive drum 51 to form an electrostatic latent image thereon, a developing device 54 which supplies toner to the photosensitive drum 51 having the electrostatic latent image formed thereon to form a toner image in response to the electrostatic latent image, and a cleaning device 55 which removes the residual toner of the photosensitive drum 51.

As the toner, known toner can be used. The toner may be a one-component developer or a two-component developer. The one-component developer is composed of toner particles. Further, the two-component developer is composed of toner particles and carrier particles. The toner particles are composed of toner base particles and external additives such as silica adhering to the surfaces thereof. The toner base particles are composed of, for example, binder resin, colorant, and wax.

The photosensitive drum 51 is, for example, a negatively charged organic photoreceptor having photoconductivity. The charging device 52 is, for example, a corona charger. The charging device 52 may be a contact charging device which causes a contact charging member such as a charging roller, a charging brush, and a charging blade to contact the photosensitive drum 51 so that the drum is charged. The exposure device 53 includes, for example, a semiconductor laser. The developing device 54 is, for example, a known developing device of an electrophotographic image forming apparatus. The "toner image" means a state where the toner is aggregated in an image.

The intermediate transfer part includes a primary transfer unit and a secondary transfer unit. The primary transfer unit includes an intermediate transfer belt 61, a primary transfer roller 62, a backup roller 63, a plurality of support rollers 64, and a cleaning device 65. The intermediate transfer belt 61 is an endless belt. The intermediate transfer belt 61 is stretched between the backup roller 63 and the support roller 64 in a loop shape. When at least one of the backup roller 63 and the support roller 64 is rotated, the intermediate transfer belt 61 runs at a constant speed in one direction on the endless track.

The secondary transfer unit includes a secondary transfer belt 66, a secondary transfer roller 67, and a plurality of support rollers 68. The secondary transfer belt 66 is also an endless belt. The secondary transfer belt 66 is stretched between the secondary transfer roller 67 and the support roller 68 in a loop shape.

The fixing device 70 is, for example, the fixing device 70 illustrated in FIG. 2. The sheet S corresponds to the recording medium.

The image reading part includes a sheet feeding device 81, a scanner 82, a CCD sensor 83, and an image processing unit 84. The recording medium conveying part includes three sheet feeding tray units 91 and a plurality of registration roller pairs 92. The sheet feeding tray unit 91 stores sheets S (specific sheet and special sheets) identified based on a basis weight, a size, and the like for each preset type. The registration roller pairs 92 are disposed to form a desired conveying path.

[Image Forming Method]

An image forming method includes a step of fixing the unfixed toner image formed on the recording medium according to the electrophotographic method onto the recording medium by heating and pressing using the fixing device. The image forming method can be performed by the image forming apparatus 50. As an example of the image forming method, the image formation using the image forming apparatus 50 will be described below.

The scanner 82 optically scans a document D on a contact glass sent from the sheet feeding device 81. Light reflected from the document D is read by the CCD sensor 83 and is used as input image data. The input image data undergoes a predetermined image process in the image processing unit 84 and is sent to the exposure device 53.

Meanwhile, the photosensitive drum 51 rotates at a constant circumferential speed corresponding to the printing speed of 60 sheets/min or more of the recording medium of A4 size.

The charging device 52 uniformly charges the surface of the photosensitive drum 51 to negative polarity. The exposure device 53 irradiates a laser beam corresponding to the input image data of each color component to the photosensitive drum 51. In this way, an electrostatic latent image is formed on the surface of the photosensitive drum 51. The developing device 54 visualizes the electrostatic latent image by attaching the toner onto the surface of the photosensitive drum 51. In this way, a toner image is formed on the surface of the photosensitive drum 51 in response to the electrostatic latent image. The toner image on the surface of the photosensitive drum 51 is transferred onto the intermediate transfer belt 61. The transfer residual toner of the photosensitive drum 51 is removed by the cleaning device 55. The toner images of different colors formed by the respective photosensitive drums 51 are transferred onto the intermediate transfer belt 61 so that the toner images sequentially overlap one another.

Meanwhile, the secondary transfer roller 67 presses the secondary transfer belt 66 toward the backup roller 63 to be brought into contact with the intermediate transfer belt 61. Accordingly, a secondary transfer nip portion is formed. Meanwhile, the sheet S is conveyed from the sheet feeding tray unit 91 to the secondary transfer nip portion through the registration roller pairs 92. The registration roller pairs 92 correct the inclination of the sheet S and adjust the conveying timing.

When the sheet S is conveyed to the secondary transfer nip portion, a transfer voltage is applied to the secondary transfer roller 67 so that the toner image on the intermediate transfer belt 61 is transferred onto the sheet S. The sheet S to which the toner image is transferred is conveyed by the secondary transfer belt 66 to the fixing device 70. The transfer residual toner on the intermediate transfer belt 61 is removed by the cleaning device 65.

In the fixing device 70, the fixing belt 10 rotates, for example, at a constant speed corresponding to the printing speed of 60 sheets/min or more of the recording medium of A4 size and the second pressing roller 73 forms a fixing nip portion along with the fixing belt 10 as described above in accordance with the conveying of the sheet S. The sheet S is heated and pressed at the fixing nip portion and is guided and discharged to the outside of the image forming apparatus 50 by the repelling force of the fixing belt 10 as described above. In this way, a toner image is formed on the sheet S and the sheet S is discharged to the outside of the apparatus.

As apparent from the description above, since the fixing belt is an endless fixing belt in which a base layer made of heat-resistant resin, an elastic layer made of an elastic material, and a release layer are laminated in this order and the linear thermal expansion coefficient of the elastic layer is $-4.0\times10^{-4}$ (1/K) or more and $1.0\times10^{-4}$ (1/K) or less, both the fixability of the toner image and the releasability of the recording medium are excellent. Further, it is more effective that the linear thermal expansion coefficient is $-1.5\times10^{-4}$ (1/K) or more and $1.0\times10^{-5}$ (1/K) or less from the viewpoint of realizing more satisfactory releasability.

Further, it is more effective that the heat-resistant resin is polyimide, the elastic material is the silicone rubber, and the material of the release layer is fluororesin from the viewpoint of easily manufacturing the fixing belt having excellent fixability and separability. At this time, it is still more effective that the fluororesin is perfluoroalkoxy fluorine resin.

Further, the fixing device includes a fixing member that includes an endless fixing belt, two or more rollers axially supporting the fixing belt, and a heating device heating the fixing belt and a pressing roller which is disposed to be relatively urged to one of the rollers with the fixing belt interposed therebetween, and the roller diameter of the roller urged by the pressing roller among the rollers is desirably 50 mm or more. Thus, the fixing operation can be performed while both the fixing of the toner image and the peeling of the recording medium are satisfactory. For this reason, the fixing device does not need to separately include a device for separating the recording medium.

Further, it is more effective that the tension of the fixing belt axially supported by the rollers is 45 N or less from the viewpoint of applying the fixing belt to the high-speed toner image fixing operation. More specifically, the fixing belt can be applied to the image formation at a fixing speed of 60 sheets/min or more (for example, 60 to 100 sheets/min).

Further, since the image forming apparatus is an image forming apparatus which includes a fixing device fixing an unfixed toner image formed on a recording medium according to an electrophotographic method onto the recording medium by heating and pressing and the fixing device is the fixing device according to the embodiment, the fixing operation can be performed while both the fixing of the toner image and the peeling of the recording medium are satisfactory. Accordingly, it is possible to inhibit a paper jam when the toner image is fixed.

EXAMPLES

The present invention will be described in more detail using the following examples and comparative examples. However, the technical scope of the present invention is not limited only to the following examples.

Example 1

<Manufacturing of Fixing Belt>

A cylindrical metal core made of stainless steel and having an outer diameter of 60 mm was closely adhered to the inside of a belt base layer made of thermosetting polyimide resin (glass transition point: 320° C.) having an inner diameter of 99 mm, a length of 360 mm, and a thickness of 70 μm. Next, a cylindrical mold holding a PFA (perfluoroalkoxyfluororesin) tube of 30 μm in thickness on an inner peripheral surface was covered on the outside of the belt base layer, the metal core and the cylindrical metal mold were held coaxially in this way, and a cavity was formed between them. Next, the silicone rubber synthesis composition A was injected into the cavity and was cured by heating at 150° C. for 2 minutes to form an elastic layer of silicone rubber A having a thickness of 200 μm. In this way, the fixing belt 1 in which the belt base layer, the elastic layer of the silicone rubber A, and the release layer of PFA were laminated in this order was manufactured. As the silicone rubber synthesis composition A, a test product manufactured by a rubber maker was used. The rubber hardness of the elastic layer made of the silicone rubber A using the silicone rubber synthesis composition A was 36, the tensile strength thereof was 1.82 MPa, the elongation thereof was 300%, and the linear thermal expansion coefficient thereof was $7.16\times10^{-5}$ (1/K). Further, the belt hardness of the fixing belt 1 was 89.8°. Further, the silicone rubber synthesis composition A contains 2 g/cm$^3$ of alumina which is a thermally conductive filler with respect to the silicone rubber synthesis composition A.

<Measurement of Physical Property of Base Layer>

The base layer made of thermosetting polyimide resin was evaluated using a solid dynamic viscoelasticity measuring device (tensile mode). As a result, the glass transition point was 320° C. as described above.

<Measurement of Physical Property of Elastic Layer>

(Rubber Hardness)

The rubber hardness of the silicone rubber A was measured by a durometer A according to JIS K6253:2012 using a measurement rubber sheet having a thickness of 2.0 mm. The rubber sheet was manufactured by the same condition as the elastic layer manufacturing condition.

(Tensile Strength)

The tensile strength of the silicone rubber A was measured by a tensilon universal tensile testing machine (manufactured by A&D Co., Ltd.) using the rubber sheet.

(Elongation)

The elongation of the silicone rubber A was measured by a tensilon universal tensile tester (manufactured by A&D Co., Ltd.) using the above rubber sheet.

(Linear Expansion Coefficient)

The linear thermal expansion coefficient of the silicone rubber A was measured by a thermomechanical test machine TM-9000 (manufactured by ADVANCE RIKO, Inc.) using a sample piece (having a length of 1 mm, a width of 1 mm, and a height of 2 mm) cut out from the rubber sheet when the temperature raised from 20° C. to 250° C. at 5° C./min.

<Measurement of Physical Property of Fixing Belt>

(Belt Hardness)

The hardness of the fixing belt 1 was measured according to JIS K 6253:2012 using an ASKER rubber hardness meter type C (manufactured by KOBUNSHI KEIKI CO., LTD.).

<Evaluation of Performance of Fixing Belt>

(Releasability)

The fixing belt 1 was installed as a fixing belt of a full-color copying machine (bizhub (registered trademark) press C 1070 manufactured by KONICA MINOLTA, INC.) which is an electrophotographic image forming apparatus having a two-axis belt type fixing device as illustrated in FIG. 2. The roller constituting the fixing nip portion has a roller diameter of 60 mm on the side supporting the fixing belt 1 and the separation angle in the fixing device at the printing speed of A4 normal sheet at 60 sheets/min is 73°. Here, the tension of the fixing belt was measured by a spring and the fixing belt was axially supported by two rollers so that the tension became 43 N. As the toner, "Digital Toner HD+" manufactured by KONICA MINOLTA, INC. was used.

A solid image having a width of 5 cm in a direction perpendicular to the conveying direction was formed on the normal sheet of A4 size, the surface temperature of the fixing belt 1 was set to 180° C., and the normal sheet of A4 size having the above-described solid image was conveyed at the speed of 60 sheets/min in the longitudinal direction. At this time, the releasability between the fixing belt 1 and the normal sheet on the image side was visually observed and evaluated according to the following criteria.

It is noted that there is no problem in practical use as long as it is a defect that a separation scratch remains slightly on the solid image.

○: A case where the sheet is separated by the fixing roller and the separation claw, but almost no separation scratch remains on the image.

Δ: A case where the sheet is separated by the fixing roller and the separation claw, but slight separation scratch remains on the image.

×: A case where the sheet is separated by the fixing roller and the separation claw, but noticeable separation scratch remains on the image or the sheet is wound on the fixing roller so that the sheet cannot be separated from the fixing roller.

No decomposition of the silicone rubber A was found at the fixing temperature when the releasability was evaluated.

Examples 2 to 7

Silicone rubber synthesis compositions B to G were prepared in the same manner as the silicone rubber synthesis composition A except that the type of dimethylpolysiloxane having a vinyl group at a side chain, the mixing ratio, and the addition amount of the additives were changed. Then, a fixing belt 2 having an elastic layer made of silicone rubber B, a fixing belt 3 having an elastic layer made of silicone rubber C, a fixing belt C1 having an elastic layer made of silicone rubber D, a fixing belt C2 having an elastic layer made of silicone rubber E, a fixing belt C3 having an elastic layer made of silicone rubber F, and a fixing belt C4 having an elastic layer made of silicone rubber G were manufactured in the same manner as the fixing belt 1 except that the addition amount of alumina corresponding to a thermally conductive filler was appropriately adjusted.

Then, various physical properties of the silicone rubbers B to G were measured in the same manner as the silicone rubber A. Further, the belt harnesses of the fixing belts 2 to 3 and C1 to C4 were measured in the same manner as the fixing belt 1. Further, the releasability was determined in the same manner as Example 1 except that each of the fixing belts 2 to 7 was used instead of the fixing belt 1. No decomposition of the silicone rubber B to G was found at the fixing temperature when the releasability was evaluated.

Various physical properties of the silicone rubbers A to G and evaluation results of the fixing belts 1 to 3 and C1 to C4 are illustrated in Table 1.

TABLE 1

| | Elastic layer Physical property | | | | | | Fixing belt | |
|---|---|---|---|---|---|---|---|---|
| | Fixing belt | Silicone rubber | Rubber hardness (–) | Tensile strength (MPa) | Elongation (%) | Linear thermal expansion coefficient (1/K) | Physical property Belt hardness (°) | Performance Releasability |
| Example 1 | 1 | A | 36 | 1.82 | 300 | $7.16 \times 10^{-5}$ | 89.8 | Δ |
| Example 2 | 2 | B | 30 | 2.05 | 396 | $-1.43 \times 10^{-4}$ | 88.4 | ○ |
| Example 3 | 3 | C | 30 | 7.20 | 790 | $-3.58 \times 10^{-4}$ | 88.5 | ○ |
| Comparative Example 1 | C1 | D | 30 | 0.55 | 207 | $2.86 \times 10^{-3}$ | 87.3 | X |
| Comparative Example 2 | C2 | E | 30 | 1.98 | 405 | $1.36 \times 10^{-3}$ | 86.2 | X |
| Comparative Example 3 | C3 | F | 30 | 1.52 | 419 | $3.50 \times 10^{-3}$ | 88.2 | X |
| Comparative Example 4 | C4 | G | 30 | 1.50 | 250 | $-4.10 \times 10^{-4}$ | 87.9 | X |

In the results of Table 1, in the fixing belts according to Examples 1 to 3 and Comparative Examples 1 to 4, the rubber hardness of the elastic layer and the belt hardness of the fixing belt were substantially the same or not greatly different.

From the comparisons of Examples 1 to 3 and Comparative Examples 1 to 4, it was found that excellent releasability was obtained when the elastic layer having a linear thermal expansion coefficient of $-4.0\times10^{-4}$ (1/K) or more and $1.0\times10^{-4}$ (1/K) or less was used.

From the results of Examples 1 to 3, it was found that more excellent releasability was obtained when the linear thermal expansion coefficient was $-1.5\times10^{-4}$ (1/K) or more and $1.0\times10^{-5}$ (1/K) or less.

From these comparisons, it is possible to check that excellent releasability is obtained by setting the linear thermal expansion coefficient within a predetermined range. This is because the deterioration of the elastic layer used to determine the lower limit of the linear thermal expansion coefficient and the size of the space formed between the fixing belt and the toner particles at the time of fixing and used to determine the upper limit of the linear thermal expansion coefficient are determined by the linear thermal expansion coefficient.

According to the present invention, since the electrophotographic image forming apparatus can further realize a high speed, high performance, and power saving, the further spread of the image forming apparatus is expected.

Although the present invention has been described and illustrated in detail, it is clearly understood that the same is by way of illustrated and example only and is not to be taken byway of limitation, the scope of the present invention being interpreted by terms of the appended claims.

What is claimed is:

1. A fixing belt comprising:

a base layer made of a heat-resistant resin;

an elastic layer made of an elastic material; and a release layer, wherein the base layer, the elastic layer, and the release layer are laminated in this order, and wherein the elastic layer has a linear thermal expansion coefficient of $-4.0\times10^{-4}$ (1/K) or more and $1.0\times10^{-4}$ (1/K) or less.

2. The fixing belt according to claim 1, wherein the linear thermal expansion coefficient is $-1.5\times10^{-4}$ (1/K) or more and $1.0\times10^{-5}$ (1/K) or less.

3. The fixing belt according to claim 1, wherein the heat-resistant resin is polyimide, the elastic material is silicone rubber, and the release layer contains fluororesin.

4. The fixing belt according to claim 3, wherein the fluororesin is perfluoroalkoxy fluorine resin.

5. A fixing device comprising:

the fixing belt according to claim 1, wherein the fixing belt is an endless fixing belt;

two or more rollers axially supporting the fixing belt;

a heating device heating the fixing belt; and a pressing roller disposed while being relatively urged toward one of the rollers with the fixing belt interposed therebetween, wherein the roller urged by the pressing roller among the rollers has a roller diameter of 50 mm or more.

6. The fixing device according to claim 5, wherein the fixing belt is axially supported by the two or more rollers so that a tension becomes 45 N or less.

7. An image forming apparatus comprising a fixing device fixing an unfixed toner image formed on a recording medium by an electrophotographic method onto the recording medium by heating and pressing, wherein the fixing device is the fixing device according to claim 5.

8. The fixing device according to claim 5, wherein the heating device is disposed in one of the two or more rollers.

* * * * *